US005705920A

United States Patent [19]

Watanabe et al.

[11] Patent Number: 5,705,920

[45] Date of Patent: Jan. 6, 1998

[54] POWER SUPPLY APPARATUS

[75] Inventors: Yoshiteru Watanabe, Sagamihara; Motohiro Sugino, Kamakura; Ryuichi Ikeda, Yokohama; Shuzo Matsumoto, Fujisawa; Kenji Kawabata; Takashi Okada, both of Tokyo, all of Japan

[73] Assignee: International Business Machines Corporation, Armonk, N.Y.

[21] Appl. No.: 722,510

[22] Filed: Sep. 27, 1996

[30] Foreign Application Priority Data

Oct. 5, 1995 [JP] Japan ..... 7-258379

[51] Int. Cl.[6] ..... G05F 1/40

[52] U.S. Cl. ..... 323/285; 363/95

[58] Field of Search ..... 323/285; 363/78, 363/95

[56] References Cited

U.S. PATENT DOCUMENTS

| | | | |
|---|---|---|---|
| 4,618,812 | 10/1986 | Kawakami | 323/285 |
| 4,626,769 | 12/1986 | Valley et al. | 323/285 |
| 4,629,970 | 12/1986 | Johansson | 323/285 |
| 5,055,767 | 10/1991 | Nelson | 323/285 |
| 5,483,463 | 1/1996 | Qin et al. | 364/492 |
| 5,594,323 | 1/1997 | Herfurth et al. | 323/285 |

*Primary Examiner*—Stuart N. Hecker
*Attorney, Agent, or Firm*—James E. Murray

[57] ABSTRACT

A power supply apparatus which stabilizes the output by feeding it back is provided which suppresses variations of the output for abrupt variations of the input. The power supply apparatus comprises output sensing means for sensing output current and output voltage, first output control means for controlling the output with the increment or decrement of the value obtained from said output sensing means, second output control means for controlling the output from an absolute value of the input voltage, and selection means for selecting either said first output control means or said second output control means. The power supply apparatus further comprises means for detecting the variation rate of the input voltage, first monitor means for monitoring the difference between the output value of said output sensing means and the reference value, and second monitor means for monitoring both the difference between the output value of said output sensing means and a reference value, and the input voltage variation rate.

4 Claims, 4 Drawing Sheets

POWER SUPPLY APPARATUS

FIELD OF THE INVENTION

The present invention relates to a power supply apparatus which generates stable power.

BACKGROUND OF THE INVENTION

A power supply apparatus described in Japanese Published Unexamined Patent Application No. 5-146156 is arranged to control duty ratio of signals for driving a switch which supplies power so as to maintain output voltage constant. This background art power supply apparatus detects the variation of output voltage with error detection means, and causes the duty ratio of Pulse Width Modulation (PWM) signals to converge the error to near zero. The control rate of this convergence is determined by the speed of a loop in which the duty ratio of PWM signals is changed after sensing of variation of the output voltage. When the input voltage varies at a rate exceeding the control rate, variation in the output voltage sometimes leads to destruction of a load.

The object of the present invention is to eliminate the above-mentioned problem, to provide a power supply apparatus to control output voltage even where the rate in variation of input voltage exceeds such a control rate.

BRIEF SUMMARY OF THE INVENTION

To attain the above-mentioned object, the present invention comprises an output sensing means for sensing output current and output voltage, first output control means for controlling the output with the increment or decrement of the value obtained from the output sensing means, second output control means for controlling the output so that the value obtained from the output sensing means is made equal to a reference value, and selection means for selecting either the first output control means or the second output control means. It further comprises voltage variation rate sensing means, first monitor means for monitoring the difference between the output value of the output sensing means and the reference value, and second monitor means for monitoring both the difference between the output value of the output sensing means and the reference value, and the input voltage variation rate.

A power supply apparatus with the above arrangement can maintain, when the input voltage is stable, a stable output by performing feedback control in increments or decrements, and, when the input voltage changes abruptly, can prevent the output voltage from being significantly shifted from a predetermined value by directly attaining a control state corresponding to the input voltage. In addition, when the input voltage variation terminates, feedback control is resumed so that the time until the output voltage is stabilized is shortened.

DETAILED DESCRIPTION OF THE INVENTION

Figure 1:
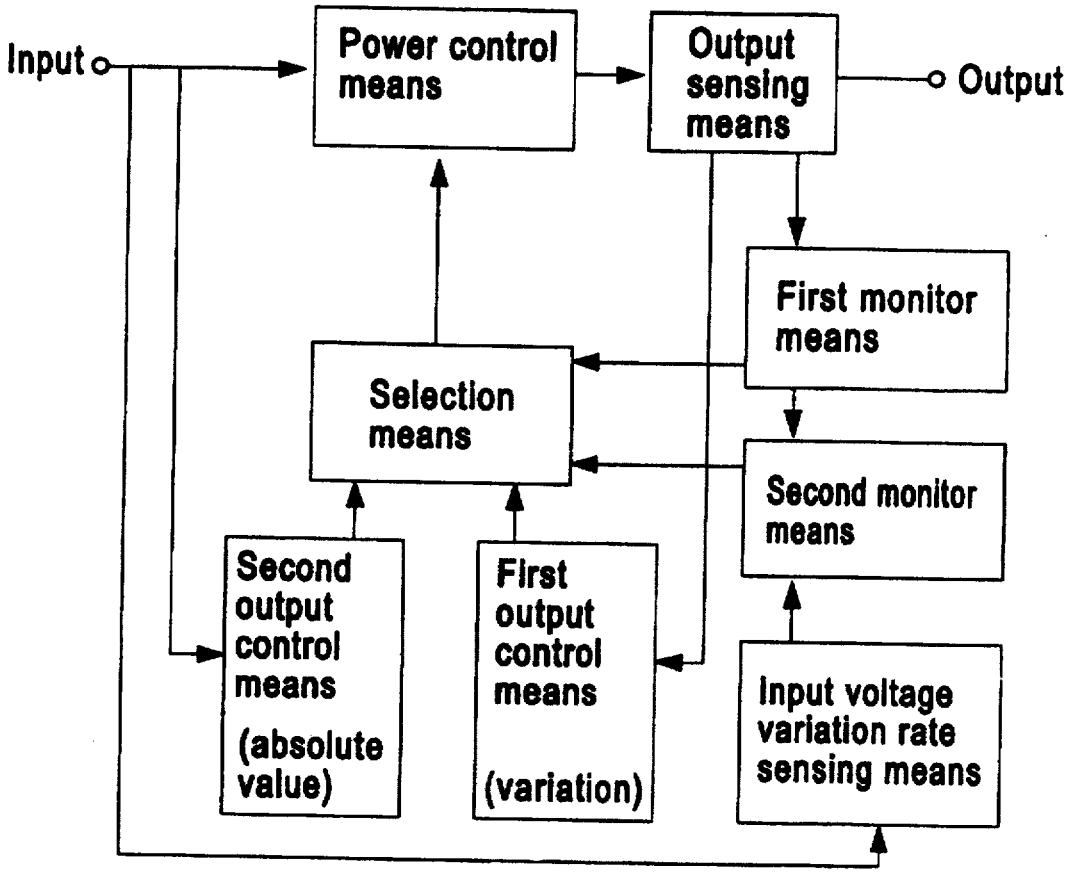
FIG. 1 is a block diagram of a power supply apparatus according to the present invention as claimed in the Claim.
Figure 2:
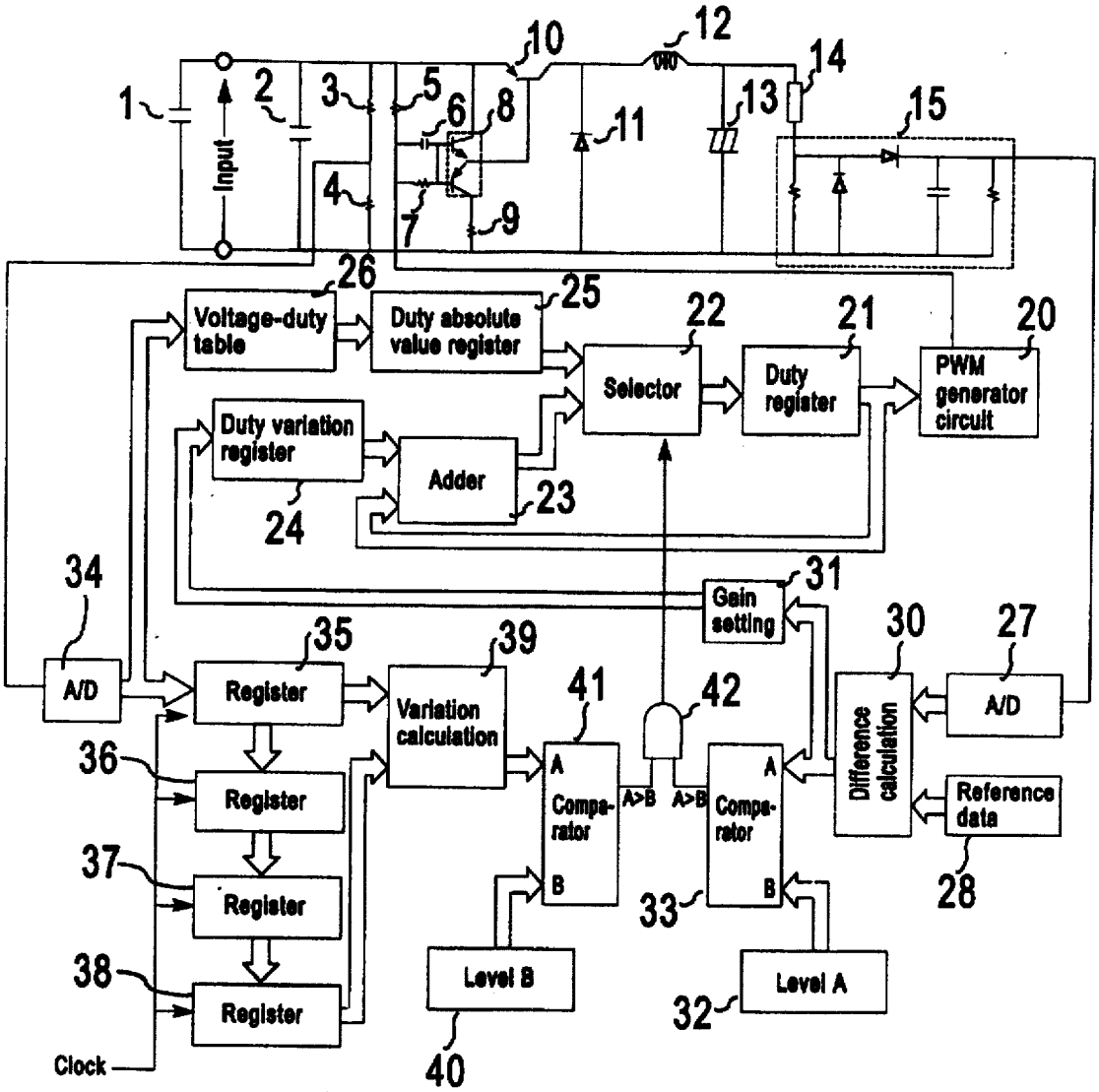
FIG. 2 is a block diagram showing an embodiment of the power supply apparatus according to the present invention.

FIG. 2 is a diagram showing an embodiment of a power supply apparatus according to the present invention. In FIG. 2, 1–14 denote power control means, while 15 denotes output sensing means. In the FIG., 1 denotes a direct current supply generating an input voltage, 2 denotes an input capacitor, 3 and 4 denote input voltage detecting resistors, 5, 7, and 9 denote resistors, 6 denotes a capacitor, 8 denotes a transistor, 10 denotes a switching transistor, 11 denotes a diode, 12 denotes a choke coil, 13 denotes an output smoothing capacitor, and 14 denotes a load. This power supply circuit is a stepdown DC-DC converter which obtains an output voltage determined by the ratio of on and off time intervals of a switching transistor 10 (that is, duty ratio) from a voltage of the input power supply 1. The PWM control for maintaining the current flowing through the load 14 constant controls the driving duty ratio for the switching transistor 10 so that the output voltage of the output sensing means 15 is maintained constant.

Furthermore, in FIG. 2, 21, 23, and 24 denote first output control means, 21, 25, and 26 denote second output control means, 27–33 denote first monitor means, 34–39 denote input voltage variation rate sensing means, 40–41 denote second monitor means, and 22 and 24 denote selection means. As shown in that figure, the output voltage of the output sensing means 15 is converted into a digital value by an A/D convertor 27. Its difference from the reference data 28 is determined by difference calculation means 30. The variation of duty ratio is determined from the result of calculation by a gain setting means 31, and set in a duty ratio variation register 24. The output duty ratio of the PWM generator circuit 20 depends on content of the duty register 21. If the select signal of the selector 22 has a polarity to select an output value of the adder 23, content of the duty register 21 is varied by an amount set in the duty ratio variation register 24. Generally, control is performed to decrease the output duty ratio when an output value of the A/D convertor 27 is larger than the reference data 28, and to increase it when the output value is smaller. This changes the duty ratio of a drive signal for the switching transistor 10 so that the output current is also changed. Normally, the control is performed in such a manner that the output voltage of the output sensing means 15 is made equal to the value of reference data 28 by the above operation.

However, when the output value of the difference calculation means 30 is larger than the value set in the level data register 32, and the input voltage variation rate detected by the A/D convertor 34, the registers 35–38, and the variation calculation means 39, is larger than the value set in the level data register 40, the selector 22 is changed over by the gate circuit 42. The duty register 21 is set to a value set in the duty absolute value register 25 by a voltage-duty table 26 from the input voltage so that the duty ratio of the drive signal for the switching transistor 10 becomes the duty ratio directly determined with the input voltage. In addition, it is arranged that the result of conversion of the input voltage to a digital value by the A/D convertor 34 is stored in the registers 35–38 in a predetermined interval, and the difference between the register 35 and the register 38 is calculated by the variation calculation means 39 to sense the input voltage variation rate. The comparator 41 determines whether the result is larger than a value set in the level data register 40.

With the arrangement described above, a power supply apparatus can be implemented, wherein in a stable state where the input voltage is stable and error in the output current is in a predetermined range, the feedback control is performed so that the output is made constant, and wherein, in a state where the input voltage changes at a rate faster than a predetermined rate and the output current varies significantly, the duty ratio can be changed to one directly determined by the input voltage, whereby, even when there occurs abrupt change in the input current which the feedback control fails to follow, the variation of output can be suppressed in a short period of time.

It may be arranged to use an invertor circuit for, for example, turning on a fluorescent lamp as the load 14, to detect the lamp current of the fluorescent lamp with the output sensing means 15, and to adjust the brightness of the fluorescent lamp with the reference data 28.

Figure 3:
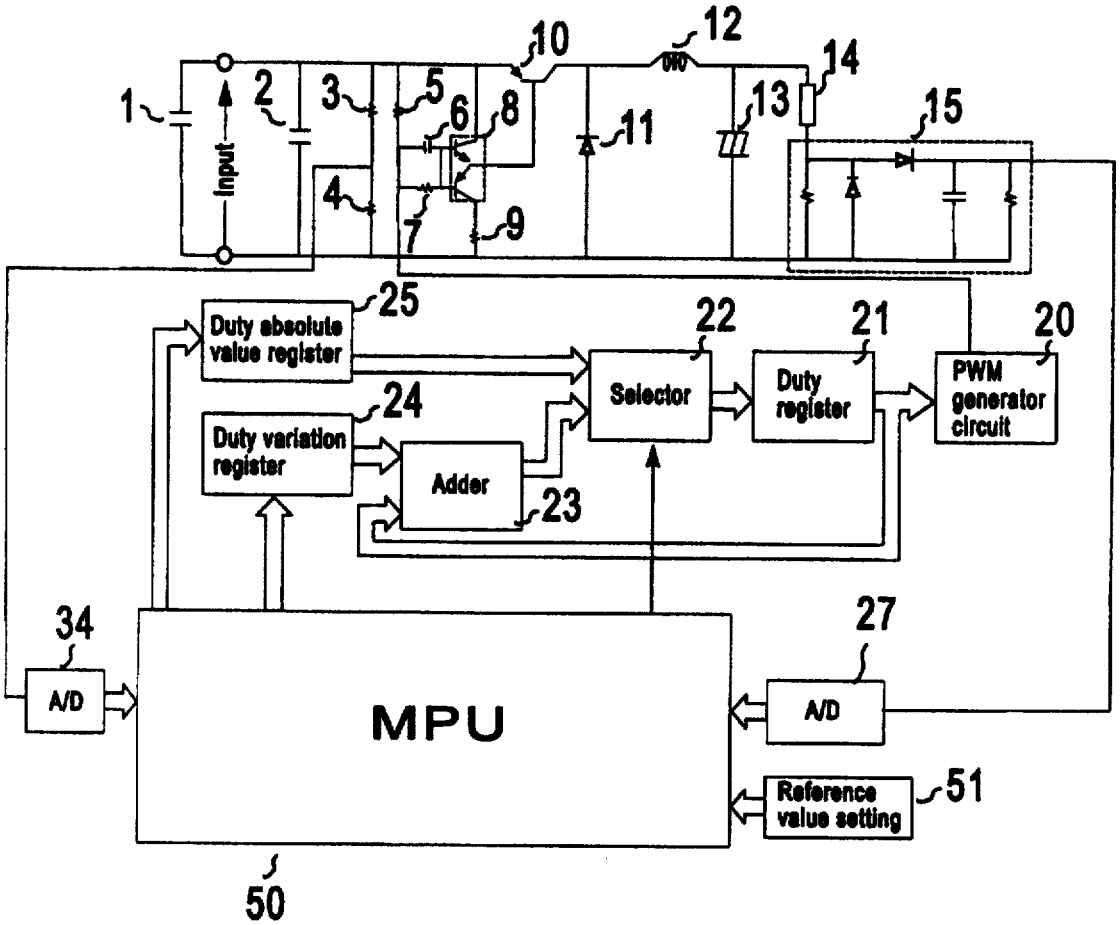
FIG. 3 is a block diagram showing another embodiment of the power supply apparatus according to the present invention which uses a microprocessor unit (MPU)

FIG. 3 is a diagram showing another embodiment of the power supply apparatus according to the present invention, which uses an MPU.

The main difference between FIG. 3 and FIG. 2 lies in that the MPU 50 is used for processing output data from the A/D convertors 27 and 34. The MPU 50 receives as its input data from the A/D convertors 27 and 34, and the reference value setting means 51, outputs data to the duty variation register 24 and the duty absolute value register 25, and outputs a change-over signal for changing over the selectors 22.

Figure 4:
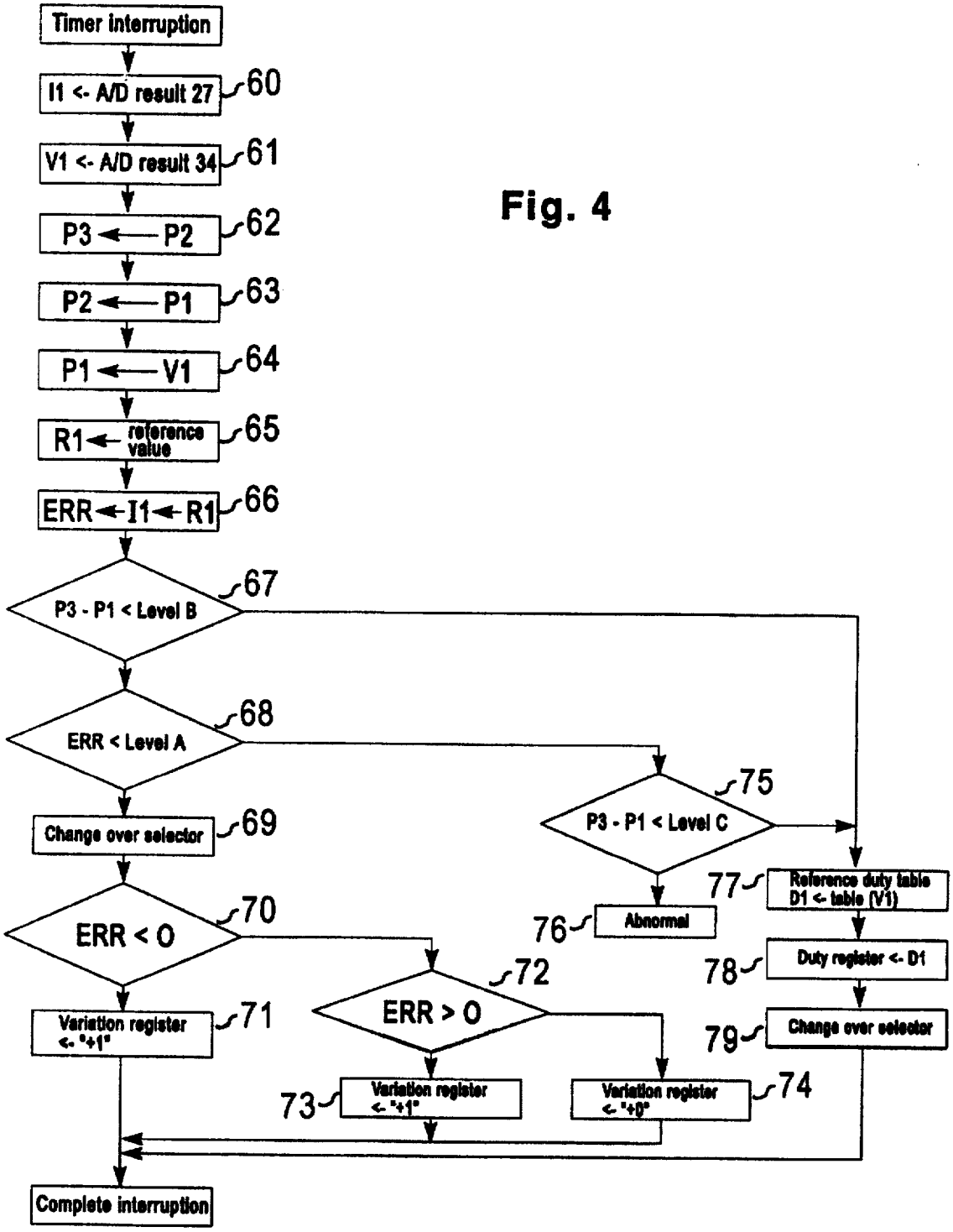
FIG. 4 is a flowchart for illustrating details of process in the MPU used in the embodiment of FIG. 3.

FIG. 4 is a flowchart for illustrating parts of process in the MPU 50. The MPU 50 contains a timer circuit, and is set to initiate the process shown in FIG. 4 in a predetermined interval. When the process is initiated, in steps 60–61, data of the A/D convertors 27 and 34 is stored in the register I1 (detected current data) and the register V1 (input voltage data), respectively. Then, in steps 62–64, history of the input voltage data is set in the registers P3, P2, and P1. The register P1 stores the current input voltage data taken in step 61, the register P2 stores the input voltage data taken in one previous timer interruption process, and the register P3 stores the input voltage data taken in further one previous timer interruption process. Then, in step 65, the reference value is taken into the register R1 from the reference value setting means 51. In step 66, difference between the register I1 (output current) and the register R1 (reference value) is stored in the ERR register. In step 67, the difference between the registers P3 and P1 is compared with the level B. This is an input voltage variation rate detection process for confirming whether the input voltage changed to exceed the level B in a predetermined period determined by the interval of timer interruption. When the variation rate is less than the level B, the process proceeds to step 68 where content of the ERR register is compared with the level A. If the ERR register is less than the level A, in step 69, the select signal is changed over so that the selector 22 of FIG. 3 selects the output from the adder 23. Thereafter, in steps 70 and 72, it is determined whether the content of the ERR register is positive or negative. According to the result, steps 71, 73 and 74 determine a value set in the duty variation register 24 as "+1," "−1" or "0," respectively, and terminate the interruption. With the above process, control is performed to decrease the duty ratio when the output current is large, and to increase the duty ratio when the output current is smaller than the reference value.

Furthermore, when, in step 67, the input voltage variation rate is higher than the level B, and when, in step 68, the ERR register is higher than the level A and the input voltage variation rate is higher than the level C, duty data corresponding to the input voltage is set in the register D1 in step 77, and the content of the register D1 is transferred to the duty absolute value register 25 in step 78. Then, in step 79, the select signal is changed over so that the selector 22 selects the output of the duty absolute value register 25. With the foregoing process, it becomes possible to perform a process which, when the input voltage varies at a rate higher than the level B and when it varies at a rate higher than the level C and an error between the output current and the reference value is larger than the level A, determines the duty data from the current input voltage and directly sets the duty ratio so that insufficient processing rate can be compensated. Here, the level C is arranged to be a value smaller than the level B.

In addition, when, in step 75, the input voltage variation rate is less than the level C, it means that the abrupt variation of the output current is caused by something other than the variation in the input voltage so that an abnormal state handling step 76 is performed to attain protective processing such as stopping the output.

With the arrangement described above, results such as those discussed in connection with FIG. 2 can be obtained. However, since this embodiment performs a process for directly determining the duty data whether or not there is variation in output when the variation rate of the input voltage is at a certain level or more, the controllability against more abrupt variation in the input voltage is enhanced. While it is arranged in the embodiment to transfer "+1"–"−1" to the variation register depending on the polarity of the ERR register, the process may be arranged to be able to transfer any value depending on the value in the ERR register. In addition, the process performed by the MPU 50 can perform finer level determination or the like, to obtain desired control characteristics.

As in the embodiment of FIG. 2, an invertor circuit can be used in this embodiment for turning on a fluorescent lamp as the load 14, and to control the lamp current of the fluorescent lamp. In addition, while the embodiments FIGS. 2 and 3 are described as performing control by detecting the output current of the load 14, they may be arranged to detect the output voltage. Furthermore, in addition to controlling the output with the duty ratio of PWM signal, similar processing can be applied in controlling a power supply apparatus the output of which varies depending on the frequency or voltage. In such a case, the area corresponding to the PWM generator circuit 20 in FIGS. 2 and 3 is replaced with a frequency or voltage generator circuit.

As described in the above, since the power supply apparatus according to the present invention can perform the feedback control with the increment or decrement of the input voltage when it is stable, and, when the input voltage abruptly changes, can prevent the output voltage from being significantly shifted from a predetermined value by directly attaining a control state corresponding to the input voltage, it is possible to stably control the output voltage even if there occurs variation of input voltage exceeding the control rate.

Description of symbols

1 . . . input power supply
2, 6, 13 . . . capacitor
3–5, 7, 9 . . . resistor
8, 10 . . . transistor
11 . . . diode
12 . . . choke coil
14 . . . load
15 . . . output sensing means
20 . . . PWM generator circuit
21 . . . duty register
22 . . . selector
23 . . . adder

24 . . . duty variation register
25 . . . duty absolute value register
26 . . . voltage vs. duty table
27, 34 . . . A/D convertor
28 . . . reference data
30 . . . difference calculation means
31 . . . gain setting means
32, 40 . . . level data register
33, 41 . . . comparator
35–38 . . . data register
39 . . . variation calculation means
42 . . . gate circuit
50 . . . MPU
51 . . . reference value setting means

We claim:

1. A power supply apparatus comprising output sensing means for sensing output current and output voltage, first output control means for controlling the output with the increment or decrement of the value obtained from said output sensing means, second output control means for controlling the output based on the absolute value of the input voltage, and selection means for selecting either said first output control means or said second output control means.

2. A power supply apparatus as set forth in claim 1 further comprising input voltage variation rate sensing means for sensing the variation rate of the input voltage, wherein either said first output control means or said second output control means is selected depending on said input voltage variation rate.

3. A power supply apparatus as set forth in claim 2 further comprising first monitor means for monitoring the difference between the output value of said output sensing means and a reference value, wherein either said first output control means or said second output control means is selected depending on said difference.

4. A power supply apparatus as set forth in claim 3 further comprising second monitor means for monitoring both the difference between the output value of said output sensing means and the reference value, and the input voltage variation rate, wherein either said first output control means or said second output control means is selected depending on the combination of these values.

* * * * *